United States Patent [19]

Yane

[11] Patent Number: 4,663,949

[45] Date of Patent: May 12, 1987

[54] DOOR LATCH ASSEMBLY

[76] Inventor: Barry Yane, 6880 Norwalk Road, Cote St-Luc, Quebec, Canada, H4W 2X6

[21] Appl. No.: 719,246

[22] Filed: Apr. 2, 1985

[51] Int. Cl.[4] ..... E05B 65/08

[52] U.S. Cl. ..... 70/100; 70/224; 292/101; 292/341.19; 292/DIG. 46

[58] Field of Search ..... 70/224, 99, 100, 96, 70/97; 292/341.18, 341.19, DIG. 46, DIG. 47, 101, 103; 403/290, 345, 354; 248/224.3, 224.4, 225.1; 49/449

[56] References Cited

U.S. PATENT DOCUMENTS

| | | | |
|---|---|---|---|
| 2,952,883 | 9/1960 | Kessler et al. | 49/449 X |
| 3,097,873 | 7/1963 | Casebolt | 292/101 X |
| 3,347,585 | 10/1967 | Chmura | 49/449 X |
| 3,756,641 | 9/1973 | Dugan | 24/486 X |
| 3,976,317 | 8/1976 | Collier | 292/340 |
| 4,068,874 | 1/1978 | Fleming et al. | 70/96 X |
| 4,099,758 | 7/1978 | Yamamoto et al. | 292/341.18 |
| 4,202,136 | 5/1980 | Riegelman | 49/449 |
| 4,378,684 | 4/1983 | Dugan et al. | 70/100 |
| 4,475,313 | 10/1984 | Governale | 70/449 X |

FOREIGN PATENT DOCUMENTS

| | | | |
|---|---|---|---|
| 1169152 | 12/1958 | France | 70/96 |
| 529238 | 7/1955 | Italy | 403/290 |

*Primary Examiner*—Robert L. Wolfe

*Attorney, Agent, or Firm*—Oblon, Fisher, Spivak, McClelland & Maier

[57] ABSTRACT

A latch assembly for securement to a common side of a sliding pane and frame to lock the sliding pane to the frame. Particularly, but not exclusively, the latch assembly is secured to a sliding door and the frame of that door. The assembly comprises a handle member having a handle housing for receiving a lock assembly having a locking element actuable therein. The housing has a slotted portion for receiving a securement flange provided on a stile on the common side of the sliding pane for securement to the flange. A keeper member is secured to the frame in alignment with the locking element to receive same therein when the lock assembly is positioned thereagainst. The handle member and keeper member are both secured to the stile and frame respectively, by fasteners which extend substantially parallel to the plane of the sliding pane.

14 Claims, 6 Drawing Figures

DOOR LATCH ASSEMBLY

BACKGROUND OF THE INVENTION

1. Field of the Invention

The present invention relates to a latch assembly for securement to a common side of a sliding pane and frame, particularly, but not exclusively, for securement to a sliding door mounted in a frame and wherein the door stile and frame are constructed of extrusion moldings.

2. Description of the Prior Art

Door latches of the general type described herein and comprising a handle housing receiving a lock assembly therein which is actuable to engage a keeper member secured to the frame of the sliding door, are known. As an example thereof, Canadian Pat. No. 963,505, issued Feb. 25, 1975, describes such a door latch assembly. However, these types of assemblies are usually secured to the stile of a sliding door and the door frame by drilling holes through the stile to install the handle housing and providing, on the inside of the door, the handle portion and the lock activation portion, and on the outside of the door stile, a cylinder plate and key receiving cylinder. The keeper member is usually installed on the side of the frame in proper alignment by fasteners extending transversely into the frame.

The disadvantage of securing the latch assembly as above described is that by drilling along the axis of the fasteners from the outside wall of the door stile or the frame, the entire handle assembly or keeper may be disengaged, thus permitting entry through the sliding door. Also, such handle assembly and keeper assembly require some precision for proper installation whereby the keeper will correctly receive the locking bolt of the handle housing in proper position therein for secured engagement. The installation is further time consuming.

SUMMARY OF THE INVENTION

It is a feature of the present invention to provide a novel latch assembly which substantially overcomes all of the above-mentioned disadvantages of the prior art and which is easy to install, does not require the drilling of holes transversely into the door stile or frame, and which fasteners cannot be removed or drilled out from the outside of the sliding door or frame.

According to the above feature, from a broad aspect, the present invention provides a door latch assembly for securement to a common side of a sliding pane and frame to lock the sliding pane to the frame. The assembly comprises a handle member having a handle housing for receiving a lock assembly having a locking element actuable therein. The housing has a slotted portion for receiving a securement flange provided on a stile on the common side of the sliding pane for securement to the flange. A keeper member is secured to the frame in alignment with the locking element to receive same therein when the lock assembly is positioned thereagainst. The handle member and keeper member are secured to the stile and frame respectively, by fastener means extending substantially parallel to the plane of the sliding pane.

BRIEF DESCRIPTION OF THE DRAWINGS

A preferred embodiment of the present invention will now be described with reference to the examples thereof as illustrated in the accompanying drawings, in which.

DESCRIPTION OF THE PREFERRED EMBODIMENTS

Figure 1:
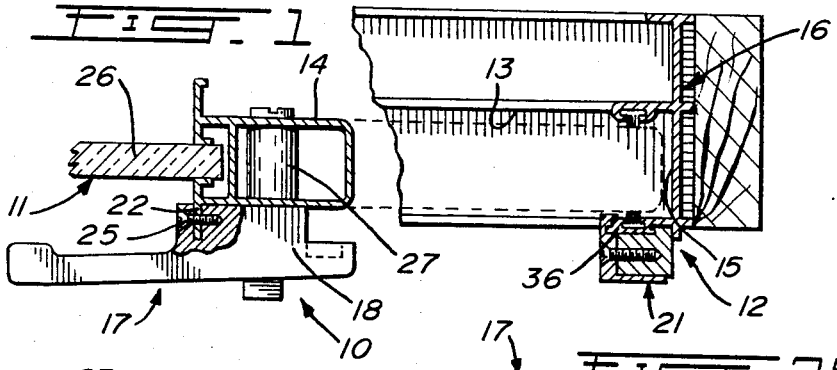
FIG. 1 is a transverse section view, partly fragmented, of the door latch assembly of the present invention as secured to a sliding door and door frame.
Figure 2A:
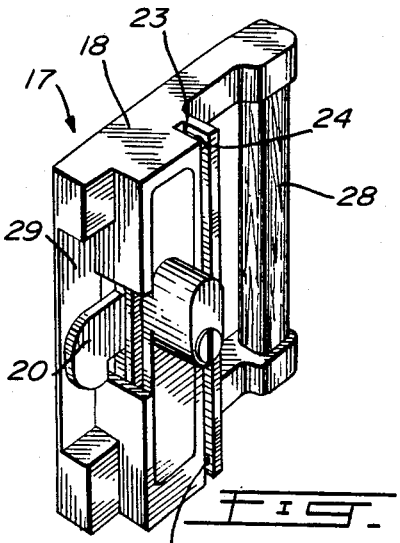
FIG. 2A is a perspective view of the handle member.
Figure 2B:
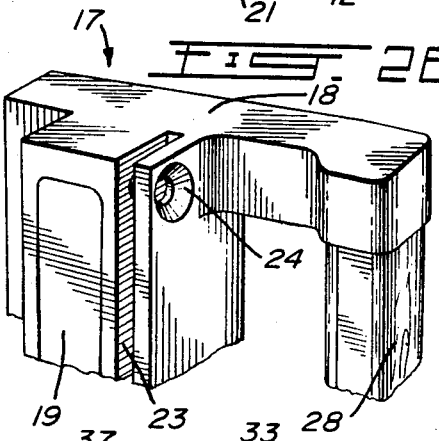
FIG. 2B is a fragmented perspective view of the handle member.
Figure 4:
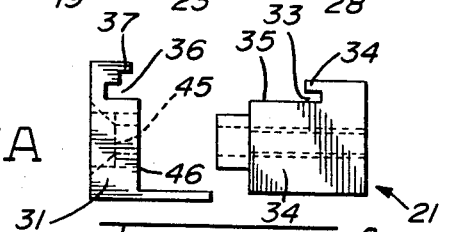
FIG. 4 is a top view of the clamp housing and clamp plate forming the keeper member.

Referring now to the drawings and more particularly to FIG. 1, there is shown generally at the door latch assembly of the present invention as secured to a common side of a sliding door 11 and a door frame 12. The sliding door 11 is slidable in a track 13 and has a door stile 14 which is received in a vertical end channel 15 of an extrusion molding usually forming part of the door frame 12. Therefore, the sliding door is sealingly retained within the frame 12.

The latch assembly comprises a handle member 17 having a handle housing 18 for receiving a lock assembly 19 having a locking element 20 actuable therein and protruding therefrom, whereby to engage into a keeper member 21 which is mounted on the frame 12 in alignment with the handle member 17.

As shown in FIG. 1, the door stile 14 is also formed from an extrusion molding which is provided wth a securement flange 22, whereby to attach the handle housing 18 to the stile 14. The handle housing 18 is formed with an elongated slot 23 having at least two bores 24 extending transversely thereacross, whereby to receive fasteners 25 therein, whereby to immovably secure the handle housing to the door stile. As shown in FIG. 1, the fasteners 25 extend substantially parallel to the plane of the sliding pane 26, whereby the fasteners 25 cannot be tampered with from the outside of the sliding door. The lock assembly 19 is also provided with a key operated cylinder 27 which extends through a through bore drilled through the door stile 14, but there are no fastener heads nor fastener ends transversely extending into the door stile.

Referring now additionally to FIGS. 2 to 5, there is illustrated the construction of the handle housing 18 and the keeper member 21. The handle housing has a handle bar 28 conveniently secured thereto, whereby to displace the sliding door in the track 13. At the other end of the housing 18, there is also provided a keeper receiving opening 29 into which the lock finger or lock bolt 20 extends.

The keeper member 21 comprises a clamp housing 30 and a clamp plate 31 which is securable to the housing 30 by one or more threaded fasteners 32. The clamp housing 30 is provided with a first gripping means in the form of a flange receiving cavity 33 extending under a gripping edge 34 formed on an attaching wall 35 of the clamp housing. Similarly, the clamp plate 31 has a flange receiving cavity 36 disposed in alignment and in facial relation to the flange receiving cavity 33, whereby when the fasteners 32 secure both the clamp housing and clamp plate together, a flange portion 36 will be clamped between the cavities 33 and 36, with clamping pressure being applied by the fasteners 32. This attachment is clearly illustrated in FIG. 1, and as can be seen, there is no need to drill any holes in the door frame as no screw fasteners extend into the frame. Also, the keeper member is easily adjustable by mounting both the clamp housing and the clamp plate loosely onto the flange portion 36 and sliding it into alignment prior to tightening the screw fasteners 32. The gripping edge 34 of the clamp housing 30 and the gripping edge 37 of the clamp plate 31 will grip into the material of the flange 36, and any vertical pressure applied thereon when the lock assembly 19 is engaged with the keeper member, will be transmitted to the entire door frame 12, thus making it impossible to disengage the lock finger 20 from the keeper member.

Figure 3:
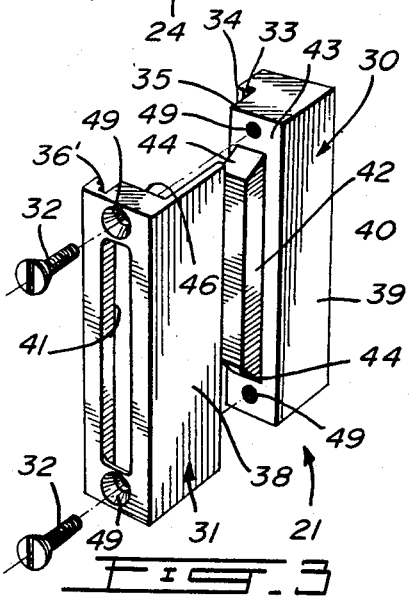
FIG. 3 is an exploded perspective view showing the component parts of the keeper member.

As shown more clearly in FIG. 3, the clamp housing 30 is formed as an elongated rectangular block having an elongated gripping edge 34 lying over the attachment wall 35. The clamp plate is shown as also being constituted as an elongated plate member and as an elongated flange receiving cavity 36' on an inside edge thereof. The plate also has a flat outside guide wall 38 which slides over the outside wall 39 of the clamp housing 30.

Both the clamp housing 30 and clamp plate 31 have an elongated aperture 40 and 41 respectively whereby to receive the locking element or locking bolt 20 therein for engagement with the keeper member. The aperture 40 is disposed within a locating ridge 42 which is elevated from the flat surface 43 of the housing 30 with the ends of the ridge having tapers 44 for mating in alignment within a locating cavity 45 formed in the inside wall 46 of the clamp plate 31, whereby to align the elongated apertures 40 and 41 with one another.

Figure 5:
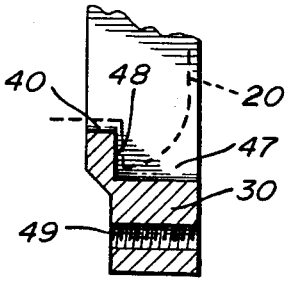
FIG. 5 is a fragmented section view of a portion of the clamp housing.

As shown in FIG. 5, the clamp housing 30 has a lock chamber 47 communicating with the elongated aperture 40. Abutment walls 48 are defined at each end of the aperture 40 and the lock finger 20 will engage behind one of them, depending if the housing 30 is secured to the right or left side of the frame. A fastener receiving bore 49 is provided adjacent each end of each of the elongated apertures 40 and 41 and are aligned with one another whereby to receive the threaded fasteners 32 therein.

It can be appreciated that the novel securement means of the handle housing and keeper member permits easy mounting and adjustment thereof anywhere along the entire height of the sliding door and door frame, as is desired. Also, experiments have demonstrated that the latch assembly offers more security than prior art assembly because of the manner in which it is secured preventing disengagement by lifting or prying the sliding door panel. Any upward movement of the door panel will be transmitted to the keeper member which will slide on the flange portion 36 maintaining the door latch assembly locked. Experiments have also demonstrated that the latch of this invention has a resistance 3 or 4 times higher than conventional latches when subjected to forced entry. This is due to the keeper construction and its securement to the frame.

It is pointed out that the keeper member 21 of the present invention can be utilized with any type of handle member having locking bolts protruding from an end thereof and capable of being received within the keeper member. The novelty of the keeper member of the present invention is the manner in which it is attached to the door frame, and the elongated apertures that receive the lock finger may be positioned slightly differently or be of different configuration than that as described herein. Also, the clamp housing and clamp plate may be constructed differently, and the locating means may be reversed. Also, the handle member 17 may be provided in combination with a standard type keeper member which is secured to the frame by fasteners and not necessarily clamped thereto. Thus, the present invention contemplates a novel handle member construction, a novel keeper member construction, and the combination of both members forming a members and the assembly can be secured to sliding window panes as well as sliding doors.

It is within the ambit of the present invention to cover any other obvious modifications of the preferred embodiment described herein, provided such modifications fall within the scope of the appended claims.

I claim:

1. A latch assembly for securement to a common side of a sliding pane and frame to lock said sliding pane to said frame, said assembly comprising a handle member having a handle housing for receiving a lock assembly having a locking element actuable therein, said housing having a slotted portion for receiving a securement flange extending outwardly of a stile on said common side of said sliding pane for securement to said flange by fasteners, and a keeper member immovably secured at a predetermined position on an attaching flange also extending outwardly of said frame and in alignment with said locking element to receive same therein when said lock assembly is positioned thereagainst, at least one threaded fastener for securing said keeper member to said attaching flange without piercing screw holes in said attaching flange, said fasteners of said handle member and keeper member being secured to their respective flanges by said fasteners which extend solely substantially parallel to the plane of said sliding pane on said common side.

2. A door latch as claimed in claim 1, wherein said slotted portion is an elongated slot formed in a flat rear wall of said handle housing for receiving therethrough a portion of said securement flange which is formed in at least a portion of said vertical stile of said door adjacent said door frame having said keeper member.

3. A door latch as claimed in claim 2, wherein there are at least two spaced-apart bores rormed across said elongated slot and parallel to said pane to receive screw fasteners therein and through said securement flange exending therein.

4. A door latch as claimed in claim 1, wherein said keeper member comprises a clamp housing having first gripping means, a clamp plate securable to said clamp housing and provided with second gripping means, said at least one threaded fastener securing said clamp plate to said clamp housing with said gripping means in alignment whereby to clampingly engage said attaching flange.

5. A door latch as claimed in claim 4, wherein said sliding pane has a metal extrusion section, said extrusion defining said attaching flange, said attaching flange being received between said first and second gripping means, said threaded fastener causing said gripping means to move toward one another to apply clamping pressure on opposed respective end edges of said flange wall at a predetermined position without piercing screw holes in said attaching flange.

6. A door latch as clamped in claim 5, wherein said clamp housing is an elongated rectangular block having an elongated gripping edge on an inside wall thereof defining an elongated flange wall receiving cavity, said clamp plate also being an elongated member and defining an elongated flange receiving cavity in an inside edge thereof, and a flat outside guide wall, and an elongated aperture in a front face of both said clamp housing and clamp plate to receive said locking element therein.

7. A door latch as clamped in claim 6, wherein there is further provided locating means associated with both said clamp housing and clamp plate to align said elongated apertures when said clamp housing and clamp plate are secured together.

8. A door latch as claimed in claim 7, wherein said locating means on said clamp housing is constituted by a locating ridge, said elongated slot being formed in said locating ridge, said slot opening into a lock chamber within said clamp housing and defining a locking element retention wall in at least one end thereof, said clamp plate having a locating cavity formed about said elongated slot and configured to receive said locating ridge in mating contact therein.

9. A door latch as clamped in claim 7, wherein a fastener receiving bore is provided adjacent each end of each of said elongated apertures and aligned with one another, there being two of said threaded fasteners, one adjacent each end of said apertures, said keeper member being clampingly engaged to said attaching flange with said elongated apertures facing said locking element and aligned therewith.

10. A keeper member for securement to an attaching flange exbanding outwardly of an inside surface of a sliding door or window frame, said keeper member comprising a clamp housing having first gripping means, a clamp plate securable to said clamp housing and provided with second gripping means, and at least one threaded fastener for securing said clamp plate to said clamp housing with said gripping means in alignment and said flange clampingly engaged between said first and second clamping means, said threaded fastener applying clamping pressure on opposed edges of said flange wall whereby to immovably secure said keeper member at any predetermined position along the flange without piercing screw holes in said flange.

11. A keeper member as claimed in claim 10, wherein said clamp housing is an elongated rectangular block having an elongated gripping edge on an inside wall thereof defining an elongated flange wall receiving cavity, said clamp plate also being an elongated member and defining an elongated flange receiving cavity in an inside edge thereof, and a flat outside guide wall, and an elongated aperture in a front face of both said clamp housing and clamp plate to receive said locking element therein.

12. A keeper member as claimed in claim 11, wherein there is further provided locating means associated with both said clamp housing and clamp plate to align said elongated apertures when said clamp housing and clamp plate are secured together.

13. A keeper member as claimed in claim 12, wherein said locating means on said clamp housing is constituted by a locating ridge, said elongated slot being formed in said locating ridge, said slot opening into a lock chamber within said clamp housing and defining a locking element retention wall in at least one end thereof, said clamp plate having a locating cavity formed about said elongated slot and configured to receive said locating ridge in mating contact therein.

14. A keeper member as claimed in claim 13, wherein a fastener receiving bore is provided adjacent each end of each of said elongated apertures and aligned with one another, there being two of said threaded fasteners, one adjacent each end of said apertures.

* * * * *